US010875272B2

(12) United States Patent
Tseng

(10) Patent No.: US 10,875,272 B2
(45) Date of Patent: Dec. 29, 2020

(54) INNER-CIRCULATION HIGH-SPEED HYDRAULIC SYSTEM, HYDRAULIC PLATFORM, AND HYDRAULIC PLATFORM ASSEMBLY

(71) Applicant: SHANGHAI ETERNAL MACHINERY CO., LTD., Shanghai (CN)

(72) Inventor: Whah Tseng, Shanghai (CN)

(73) Assignee: SHANGHAI ETERNAL MACHINERY CO., LTD., Shanghai (CN)

( * ) Notice: Subject to any disclaimer, the term of this patent is extended or adjusted under 35 U.S.C. 154(b) by 828 days.

(21) Appl. No.: 15/104,201

(22) PCT Filed: Jul. 21, 2014

(86) PCT No.: PCT/CN2014/000691
§ 371 (c)(1),
(2) Date: Jun. 13, 2016

(87) PCT Pub. No.: WO2015/085648
PCT Pub. Date: Jun. 18, 2015

(65) Prior Publication Data

US 2016/0311217 A1 Oct. 27, 2016

(30) Foreign Application Priority Data

Dec. 12, 2013 (CN) ..... 2013 1 0682896

(51) Int. Cl.
*B30B 1/23* (2006.01)
*F15B 3/00* (2006.01)
(Continued)

(52) U.S. Cl.
CPC ..... *B30B 1/23* (2013.01); *B30B 1/007* (2013.01); *B30B 15/0052* (2013.01);
(Continued)

(58) Field of Classification Search
CPC ..... F15B 1/02; F15B 1/26; F15B 9/00; F15B 11/072; F15B 11/0725; F15B 15/00;
(Continued)

(56) References Cited

U.S. PATENT DOCUMENTS 2,825,671 A * 3/1958 Huffman ..... B32B 17/10862 100/155 G
3,304,077 A * 2/1967 Eaton ..... F16F 9/06 267/64.25
(Continued)

FOREIGN PATENT DOCUMENTS

CA 2594644 A1 * 7/2006 ..... B30B 1/32
CN 2656134 Y 11/2004
(Continued)

OTHER PUBLICATIONS

Chinese Office Action for related Application No. CN201310682896.1 dated May 10, 2016.
(Continued)

*Primary Examiner* — Shelley M Self
*Assistant Examiner* — Katie L. Parr
(74) *Attorney, Agent, or Firm* — Troutman Pepper Hamilton Sanders LLP; James E. Schutz; Nicholas Doss

(57) ABSTRACT

An inner-circulating high speed hydraulic system, a hydraulic platform and a hydraulic platform assembly consisting of said systems, wherein the inner-circulating high speed hydraulic system comprises a hydraulic cylinder component and a pressure valve component, the hydraulic cylinder component including a high pressure cylinder, a hydraulic plunger, and a housing, wherein an axial hole and radial holes intersecting with the axial hole are disposed at the top/bottom of the high pressure cylinder and the high pressure cylinder is contained within the housing, wherein the inner-circulating oil chamber may communicate with the
(Continued)

axial hole via the radial holes and further communicate with chambers at the top/bottom of the hydraulic plunger, wherein compressed air inlets are disposed on the housing and a lower end of the hydraulic plunger is connected to an actuating element; and a pressure valve component, comprising a pressure servo motor and a pressure plunger driven by the pressure servo motor to move up and down within the axial hole disposed at the top/bottom of the high pressure cylinder. Accurate control on dwell time for pressing at the up and down stop points of the platform, and highly precise adjustment to duration of the dwell time are enabled by the present invention. Thus, a stamping process with high quality is achieved.

19 Claims, 11 Drawing Sheets

(51) Int. Cl.

| | |
|---|---|
| ***B30B 15/00*** | (2006.01) |
| ***B30B 1/00*** | (2006.01) |
| ***F15B 11/072*** | (2006.01) |
| ***F15B 15/00*** | (2006.01) |
| ***F15B 1/02*** | (2006.01) |
| ***B44B 5/00*** | (2006.01) |
| *B41F 16/00* | (2006.01) |
| *B44B 5/02* | (2006.01) |
| *B41F 19/06* | (2006.01) |

(52) U.S. Cl.
CPC ..... *B44B 5/0019* (2013.01); *F15B 1/02* (2013.01); *F15B 3/00* (2013.01); *F15B 11/072* (2013.01); *F15B 15/00* (2013.01); *B41F 16/0046* (2013.01); *B41F 19/068* (2013.01); *B41P 2219/11* (2013.01); *B44B 5/028* (2013.01); *F15B 11/0725* (2013.01); *F15B 2211/405* (2013.01)

(58) Field of Classification Search
CPC ..... F15B 2210/00; F15B 2210/405; F15B 11/127; F15B 11/128; B30B 1/007; B30B 1/181; B30B 1/186; B30B 1/23; B30B 1/32; B30B 1/34; B30B 1/36; B30B 1/38; B30B 15/0052
USPC ..... 100/287, 289, 290, 48, 270, 271; 417/531; 72/452
See application file for complete search history.

(56) References Cited

U.S. PATENT DOCUMENTS

| | | | | |
|---|---|---|---|---|
| 4,074,624 | A * | 2/1978 | Biomstad | B21B 37/36 100/170 |
| 5,259,345 | A * | 11/1993 | Richeson | F01L 9/04 123/90.12 |
| 2007/0068399 | A1* | 3/2007 | Anderson | B30B 1/18 100/269.06 |
| 2008/0245067 | A1* | 10/2008 | Rapp | F15B 3/00 60/494 |
| 2010/0307349 | A1* | 12/2010 | Martin | B30B 1/32 100/35 |
| 2015/0273554 | A1* | 10/2015 | Yukita | B30B 15/22 72/20.1 |

FOREIGN PATENT DOCUMENTS

| | | | |
|---|---|---|---|
| CN | 1727185 | A | 2/2006 |
| CN | 1807903 | A | 7/2006 |
| CN | 101074691 | A | 11/2007 |
| CN | 102658719 | A | 9/2012 |
| CN | 203784023 | | 8/2014 |
| JP | 50037980 | A * | 3/1975 |
| KR | 20110074018 | A * | 6/2011 |

OTHER PUBLICATIONS

The International Search Report and Written Opinion for PCT Application No. PCT/CN2014/000691 dated Oct. 15, 2014.

* cited by examiner

INNER-CIRCULATION HIGH-SPEED HYDRAULIC SYSTEM, HYDRAULIC PLATFORM, AND HYDRAULIC PLATFORM ASSEMBLY

This application is a U.S. National Stage of International Application No. PCT/CN2014/000691 filed 21 Jul. 2014, which claims the benefit of Chinese Patent Application No. 201310682896.1 filed 12 Dec. 2013, each herein fully incorporated by reference.

FIELD OF THE INVENTION

The present invention is generally related to a hydraulic system, a hydraulic platform and a hydraulic platform assembly used in stamping processes. In particular, the present invention relates to an inner-circulating high speed hydraulic system which performs hydraulic actions in high speed with inner circulation, and also relates to an inner-circulating high speed hydraulic platform and an inner-circulating high speed hydraulic platform assembly comprising the inner-circulating high speed hydraulic system.

BACKGROUND

In stamping processes for packaging and printing industry, a stamping platform of a platen foil stamping machine is desired to maintain a constant paper-pressing time regardless of speeds, and set adaptive pressing times according to different requirements of products to be stamped, thereby achieving hot stamping pictures with high quality. At present, for a mechanical moving-platform consisting of crank shaft and swing-rod transmission mechanism, the dwell time for pressing at a stop point on the platform varies with changing speeds due to its inherent structure. Thus, it is difficult to guarantee quality of prints. While for hydraulic platforms consisting of conventional hydraulic servo systems, its hydraulic system mainly comprises a hydraulic valve, a hydraulic cylinder, a servo valve, an energy storage system, and lines. Such kind of a conventional hydraulic system has numerous components and complicated structures, causing a relatively high maintenance cost and defects of low efficiency and loud noise. Current hydraulic systems in the art can hardly provide hydraulic actions with high speed, high pressure and high precision at the same time. Thus, further improvements are needed.

Accordingly, it is desired to improve moving-platform systems in stamping processes, enabling the moving-platform systems to accurately control the dwell time for pressing at upper and lower stop points of platforms, adjust the length of the dwell time as required, and provide hydraulic actions with high speed, high pressure and high precision at the same time.

SUMMARY

Aiming at the above defects, an objective of the present invention is to provide an inner-circulating high speed hydraulic system with simple structure, high efficiency and high precision, an inner-circulating high speed hydraulic platform and an inner-circulating high speed hydraulic platform assembly comprising the inner-circulating high speed hydraulic system by combining servo motor technology with inner-circulating pressing technology.

Based on the above objective, the present invention firstly provides an inner-circulating high speed hydraulic system, comprising: a hydraulic cylinder assembly and a pressure valve assembly, the hydraulic cylinder assembly including a high pressure cylinder, a hydraulic plunger, and a housing, wherein an axial hole disposed at the top of the high pressure cylinder may communicate with a chamber on the top of the hydraulic plunger, wherein at least one radial hole intersecting with the axial hole is also disposed near the top of the high pressure cylinder, wherein the plunger reciprocates in the high pressure cylinder, wherein the housing contains the high pressure cylinder and forms a sealed inner-circulating oil chamber outside, wherein the inner-circulating oil chamber may communicate with the axial hole via the at least one radial hole and in turn communicate with the top of the hydraulic plunger, wherein a compressed air inlet is disposed on the upper portion of the housing and the lower end of the hydraulic plunger is connected to an actuating element; and the pressure valve assembly comprising a pressure servo motor and a pressure plunger, the pressure plunger may be driven by the pressure servo motor to move up and down within the axial hole disposed on the top of the high pressure cylinder.

Preferably, the actuating element is a moving platen of a moving platform.

Preferably, the hydraulic system further comprises a moving platen lifting component connected to the moving platen, and comprising: a lifting servo motor and a lifting mechanism, wherein the lifting mechanism may be driven by the lifting servo motor so that the moving platen may have lifting motion according to a preset lifting curve.

By using the lifting mechanism, the stroke and the stop positions of the moving platen might be accurately controlled.

Preferably, the lifting mechanism comprises a lifting ball screw and a lifting nut engaged with the lifting ball screw for moving, wherein the lifting ball screw is connected to the lifting servo motor while the lifting nut is connected to the moving platen.

Preferably, a driving mechanism may be disposed between the pressure servo motor and the pressure plunger.

Preferably, the driving mechanism comprises a pressure ball screw and a pressure nut engaged with the pressure ball screw for moving, wherein the pressure ball screw is connected to the pressure servo motor while the pressure nut is connected to the pressure plunger.

Preferably, the pressure plunger may be directly driven by the pressure servo motor.

The present invention further provides an inner-circulating high speed hydraulic platform, comprising: an upper fixed platform on which at least one aforementioned inner-circulating high speed hydraulic system is connected; a moving platen lifting assembly connected to an actuating element, comprising a lifting servo motor and a lifting mechanism driven by the lifting servo motor to facilitate the actuating element to perform lifting motion; and a control system for controlling the above components to act in proper time and controlling the servo motors in the inner-circulating high speed hydraulic system to operate synchronously.

Preferably, the lifting mechanism comprises a lifting ball screw and a lifting nut engaged with the lifting ball screw for moving, wherein the lifting ball screw is connected to the lifting servo motor while the lifting nut is connected to the moving platen.

Preferably, the control system comprises a controller and drivers corresponding to the pressure servo motors of the at least one inner-circulating high speed hydraulic system as well as a driver corresponding to the lifting servo motor, wherein the controller is configured to: send actuating commands to the driver corresponding to the lifting servo motor so that the hydraulic plunger is driven to move downward, which in turn brings the actuating element to move downward; when the actuating element stops moving downward, the controller may receive an in-position signal from the driver of the lifting servo motor and send commands to each driver of the pressure servo motors for synchronously running so as to synchronously drive each pressure plunger entering into high pressure oil chambers and sealing the radial holes; send commands to each driver of the pressure servo motors for synchronously reverse running so as to synchronously drive each pressure plunger to synchronously exit the high pressure oil chambers upward; and send commands to the driver of the lifting servo motor for driving the hydraulic plunger to move reversely, which in turn brings the actuating element to move upward.

Preferably, controlling pressure servo motors for synchronously running includes any of parallel control, master-slave control, cross-coupling control, virtual line-shaft control, and relative coupling control.

Preferably, the controller is a PLC or a motion controller.

The present invention further provides an inner-circulating high speed hydraulic platform assembly, comprising: an aforementioned inner-circulating high speed hydraulic platform; a moving platen connected to the actuating element; an upper fixed platform with which the moving platen may contact with zero speed and press against tightly when the actuating element reciprocates to the upper stop point; a lower fixed platform with which the moving platen may contact with zero speed and press against tightly when the actuating element reciprocates to the lower stop point; and a connecting mechanism for connecting and fixing the upper fixed platform and the lower fixed platform, wherein housings of hydraulic cylinder components are fixed to the upper fixed platform, wherein the high pressure cylinder is contained in a via formed in the upper fixed platform and fixed to said upper fixed platform.

Preferably, the connecting mechanism comprises a right wallboard and a left wallboard which are connected between the upper and lower fixed platform.

The present invention further provides another inner-circulating high speed hydraulic platform, comprising:

a lower fixed platform, connected thereon with:

at least one inner-circulating high speed hydraulic system, comprising:

a hydraulic cylinder component, including a high pressure cylinder, a hydraulic plunger, and a housing, wherein an axial hole disposed at the bottom of the high pressure cylinder may communicate with a chamber in the lower portion of the hydraulic plunger, wherein at least one radial hole intersecting with the axial hole is also disposed near the bottom of the high pressure cylinder, wherein the plunger reciprocates in the high pressure cylinder, wherein the housing contains the high pressure cylinder and forms a sealed inner-circulating oil chamber outside, wherein the inner-circulating oil chamber may communicate with the axial hole via the at least one radial hole and further in turn communicate with the chamber in the lower portion of the hydraulic plunger, wherein a compressed air inlet is disposed on the housing and an upper end of the hydraulic plunger is connected to a actuating element; and a pressure valve component, comprising a pressure servo motor and a pressure plunger driven by the pressure servo motor to move up and down within the axial hole disposed at the bottom of the high pressure cylinder;

a moving platen lifting component connected to the actuating element and comprising a lifting servo motor and a lifting mechanism, wherein the lifting mechanism may be driven by the lifting servo motor to enable the actuating element to perform lifting motion; and a control system for controlling the above components to act in proper time and controlling the servo motors in the inner-circulating high speed hydraulic system to operate synchronously.

Preferably, the lifting mechanism comprises a lifting ball screw and a lifting nut engaged with the lifting ball screw for moving, wherein the lifting ball screw is connected to the lifting servo motor while the lifting nut is connected to the moving platen.

Preferably, the control system comprises a controller and drivers corresponding to the pressure servo motors of the at least one inner-circulating high speed hydraulic system as well as a driver corresponding to the lifting servo motor, wherein the controller is configured to send actuating commands to the driver corresponding to the lifting servo motor so that the hydraulic plunger is driven to move upward, which in turn brings the actuating element to move upward; when the actuating element stops moving upward, the controller may receive an in-position signal from the driver of the lifting servo motor and send commands to each driver of the pressure servo motors for synchronously running so as to synchronously drive each pressure plunger synchronously entering into high pressure oil chambers and sealing the radial holes; send commands to each driver of the pressure servo motors for synchronously reverse running so as to synchronously drive each pressure plunger to synchronously exit the high pressure oil chambers downward; and send commands to the driver of the lifting servo motor for driving the hydraulic plunger to move reversely, which in turn brings the actuating element to move downward.

Preferably, controlling pressure servo motors for synchronously running includes any of parallel control, master-slave control, cross-coupling control, virtual line-shaft control, and relative coupling control.

Preferably, the controller is a PLC or a motion controller.

The present invention further provides another inner-circulating high speed hydraulic platform assembly, comprising: an aforementioned inner-circulating high speed hydraulic platform; a moving platen connected to the actuating element; an upper fixed platform with which the moving platen may contact with zero speed and press against tightly when the actuating element reciprocates to the upper stop point; and a connecting mechanism for connecting and fixing the lower fixed platform and the upper fixed platform, wherein housings of hydraulic cylinder assemblies are fixed to the lower fixed platform, wherein a pressure valve component passes through a via formed in the lower fixed platform and is fixed to the lower fixed platform.

Preferably, the connecting mechanism comprises a right wallboard and a left wallboard which are connected between the lower and upper fixed platforms.

The inner-circulating high speed hydraulic system in the present invention combines servo motor technology with inner-circulating pressing technology. By means of the hydraulic system in the present invention, hydraulic pumps, servo valves, energy storage systems and all hydraulic lines in conventional hydraulic systems may be eliminated. As the present system does not need all lines and servo valves in conventional technologies, hydraulic loss is very little and operational efficiency is much higher than existing technologies.

Further, with the inner-circulating high speed hydraulic platform in the present invention, inner-circulation and pressurization of hydraulic oil are achieved while the number of components is merely one third of that in conventional moving-platform. A stamping process with a high speed of 8000 sheets/hour and a positional repeatability of ±0.01 mm is able to be realized. Furthermore, accurate control on dwell time for pressing at upper and lower stop points of platforms and adjustment to lengths of dwell time are enabled. Thus, a high quality stamping process is accomplished. Meanwhile, the inner-circulating high speed hydraulic platform is also highly applicable in other stamping devices requiring high speed, high pressure and high precision.

The inner-circulating high speed hydraulic platform assembly in the present invention has a compact structure with decreased overall height, and is easy for transportation.

BRIEF DESCRIPTION OF THE DRAWINGS

Other features and advantages of the present invention will become more obvious from the detailed description set forth below when taken in conjunction with the drawings. In the drawings.

DETAILED DESCRIPTION

Figure 1:
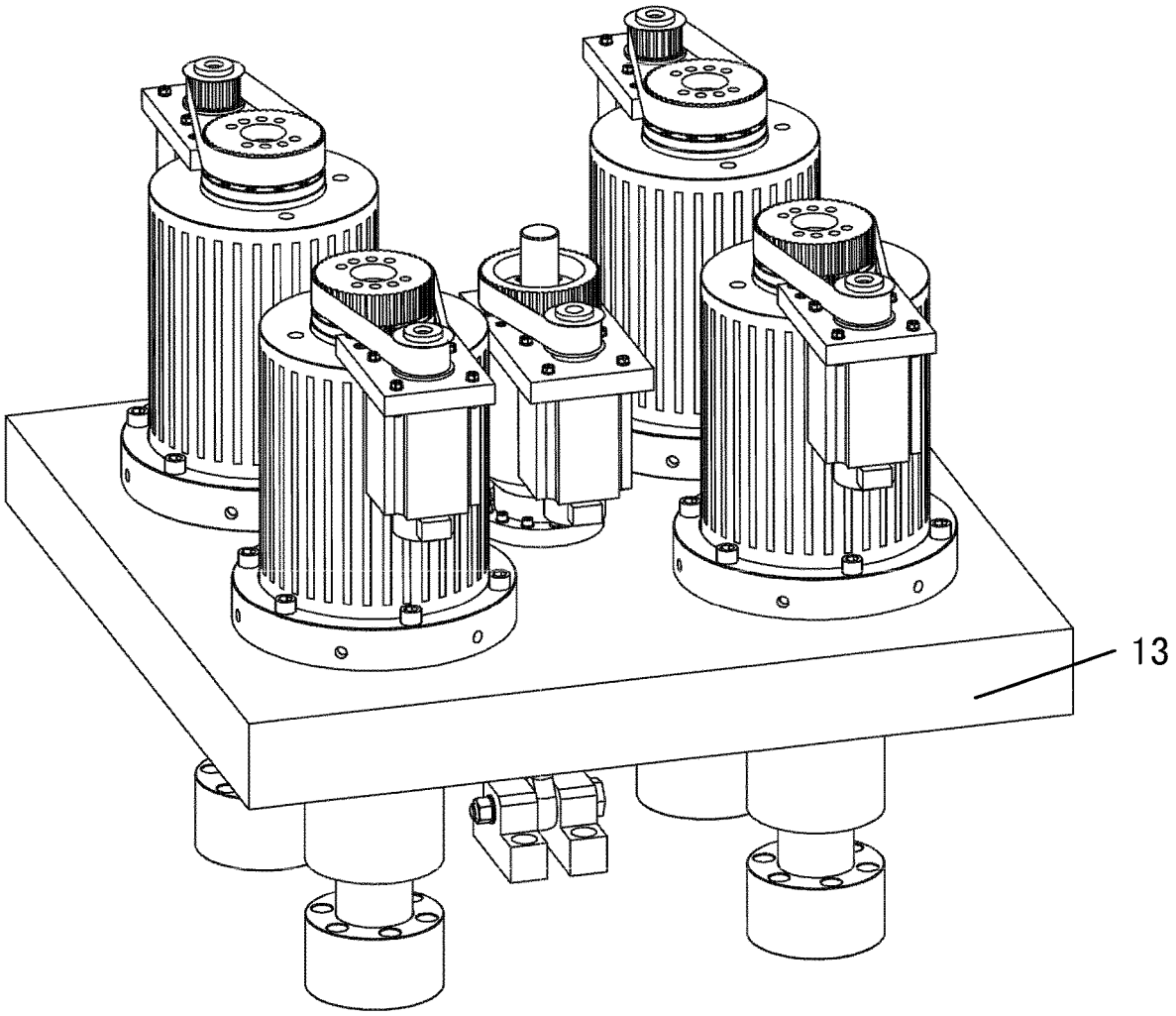
FIG. 1 illustrates a perspective view of an inner-circulating high speed hydraulic platform according to a first embodiment of the present invention, wherein a support for fixing the inner-circulating high speed hydraulic platform to a stamping machine, a control system, a moving platen and a lower fixed platform are omitted for clarity.

FIG. 1 shows a perspective view of an inner-circulating high speed hydraulic platform according to a first embodiment of the present invention. The inner-circulating high speed hydraulic platform mainly comprises: an upper fixed platform 13, a moving platen lifting component, a plurality of inner-circulating high speed hydraulic systems (for example, 2, 3, and 5 etc. and specifically 4 in the present embodiment) mounted to the upper fixed platform 13, and a control system (not shown). The moving platen lifting component is used for pushing a moving platen 16 to move toward a lower fixed platform 17 and contact the lower fixed platform 17 with zero speed (See FIG. 2). The inner-circulating high speed hydraulic systems are used for supplying fluids to the hydraulic system when pushing the moving platen 16 toward the lower fixed platform 17 and applying pressure on the lower fixed platform 17 after the moving platen 16 contacts the lower fixed platform 17. The control system is used for sending corresponding commands to the respective components according to action requirements and receiving related feedback information so as to ensure reliable operation of the inner-circulating high speed hydraulic platform with high speed, high pressure and high precision.

In this embodiment, the inner-circulating high speed hydraulic platform comprises four identical inner-circulating high speed hydraulic systems. However, it should be understood that the present invention is not limited to four identical inner-circulating high speed hydraulic systems, but may have any appropriate number of systems, such as 2, 3, etc. Those four identical inner-circulating high speed hydraulic systems have same structures and operational processes. Herein, only one of the systems is described in details with reference to FIGS. 2-4.

Figure 2:
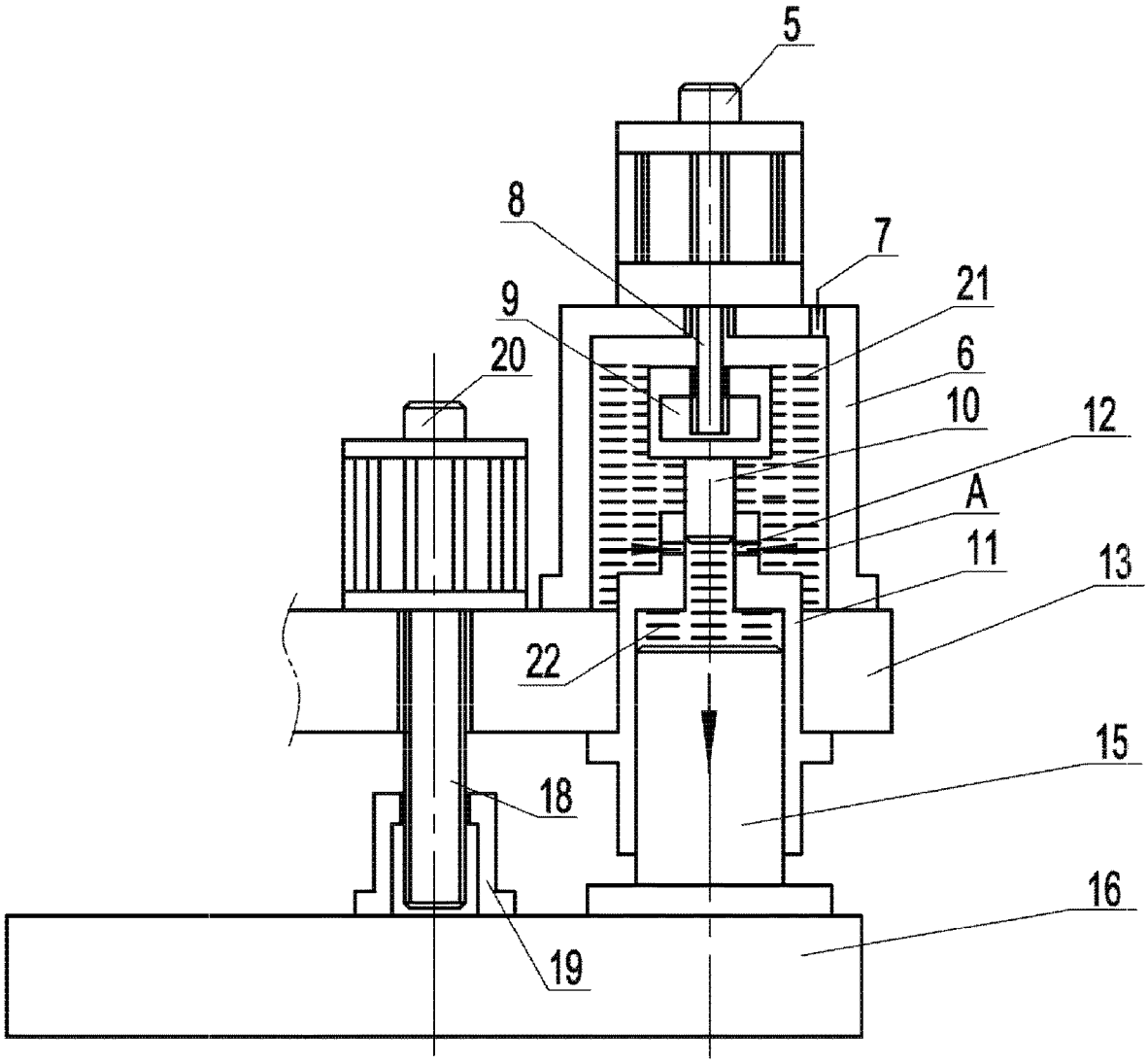
FIG. 2 is a static section view of an inner-circulating high speed hydraulic system according to a first embodiment of the present invention.

FIG. 2 shows a stationary state of an inner-circulating high speed hydraulic system as well as a moving platen lifting component according to a first embodiment of the present invention. The inner-circulating high speed hydraulic system includes a hydraulic cylinder component and a pressure valve component.

The hydraulic cylinder component includes: a high pressure cylinder 11, a hydraulic plunger 15, and a housing 6. An axial hole, disposed on the top of the high pressure cylinder 11, may communicate with a chamber on the top of the hydraulic plunger 15. At least one radial hole(s) 12 intersecting with the axial hole is also disposed near the top of the high pressure cylinder 11. The plunger 15 reciprocates in the high pressure cylinder 11 and the lower end of the plunger 15 may connect to an actuating element, which in a preferred embodiment is a moving platen 16. The housing 6 contains the high pressure cylinder and forms a sealed inner-circulating oil chamber outside. The inner-circulating oil chamber may communicate with the axial hole with the aforementioned at least one radial hole 12 and in turn communicate with the top of the hydraulic plunger 15. In addition, a compressed air inlet 7 is disposed in the upper portion of the housing 6 for introducing compressed air.

A pressure valve component comprising a pressure servo motor 5 and a pressure plunger 10 is disposed on the top of the hydraulic cylinder component. The pressure plunger 10 may be driven by the pressure servo motor 5 to move up and down within an axial hole disposed on the top of the high pressure cylinder 11. In this embodiment, a driving mechanism may be disposed between the pressure servo motor 5 and the pressure plunger 10. The driving mechanism comprises a pressure ball screw 8 and a pressure nut 9 engaged with the pressure ball screw 8 for moving. The pressure ball screw 8 is connected to the pressure servo motor 5 and supported by a bearing to rotate. The pressure nut 9 is connected to a pressure plunger 10.

It should be understood that the pressure plunger 10 may be directly driven by servo motor 5, if desired.

The functions of the pressure valve component are as follows. The pressure servo motor 5 enables the pressure plunger 10 to appropriately turn off hydraulic oil in at least one radial hole 12 of the hydraulic cylinder component according to command(s) received from the control system, which in turn enables the pressure plunger 10 to move into the high pressure oil chamber 22 at the top of the hydraulic plunger 15. When the pressure plunger continues to move downward, the low pressure hydraulic oil 21 in the top of the hydraulic plunger 15 will be compressed, which will increase the pressure in the seal chamber (up to 400 kg/cm$^2$) and generate a significant thrust on the hydraulic plunger 15. Provided that the moving distance of the pressure plunger 10 toward the hydraulic plunger 15 is controlled, the generated thrust of the hydraulic plunger 15 and its highly precise position (for example, with a positional repeatability of ±0.01 mm) may be controlled.

FIG. 2 also shows a moving platen lifting component. The moving platen lifting component is connected to said moving platen 16, comprising: a lifting servo motor 20 and a lifting mechanism. The lifting mechanism may be driven by the lifting servo motor 20, causing the moving platen 16 to perform lifting motion according to a preset lifting curve. In this embodiment, the lifting mechanism comprises a lifting ball screw 18 and a lifting nut 19 engaged with the lifting ball screw 18 for moving. The lifting ball screw 18 is connected to the lifting servo motor 20 while the lifting nut 19 is connected to the moving platen 16.

The moving platen lifting component enables the moving platen 16 to approach the fixed platform with high speed and zero-speed contact with the fixed platform with high precision and press it tightly. Meanwhile, the hydraulic plunger 15 fixed on the moving platen 16 is pulled to have oil supplied or discharged from the high pressure hydraulic cylinder 11 thereon.

Hereinafter, the action process of the hydraulic system according to a preferred embodiment of the present invention will be described with respect to FIGS. 2-4.

In FIG. 2, the hydraulic system is in a stationary state. In this state, low pressure compressed air enters an inner-circulating oil chamber via a compressed air inlet 7, causing the hydraulic oil 21 to flow into the top of the hydraulic plunger 15 through radial holes 12 along direction A so that the hydraulic plunger 15 is enabled to generate a low pressure thrust downward. At this time, the moving platen lifting component is constrained by a static torque generated from the servo motor 20, which in turn constrains the moving platen 16 and the hydraulic plunger 15 to maintain in a stationary state as shown in FIG. 2. This state is referred as "origin state" for the hydraulic system in the present invention.

Figure 3:
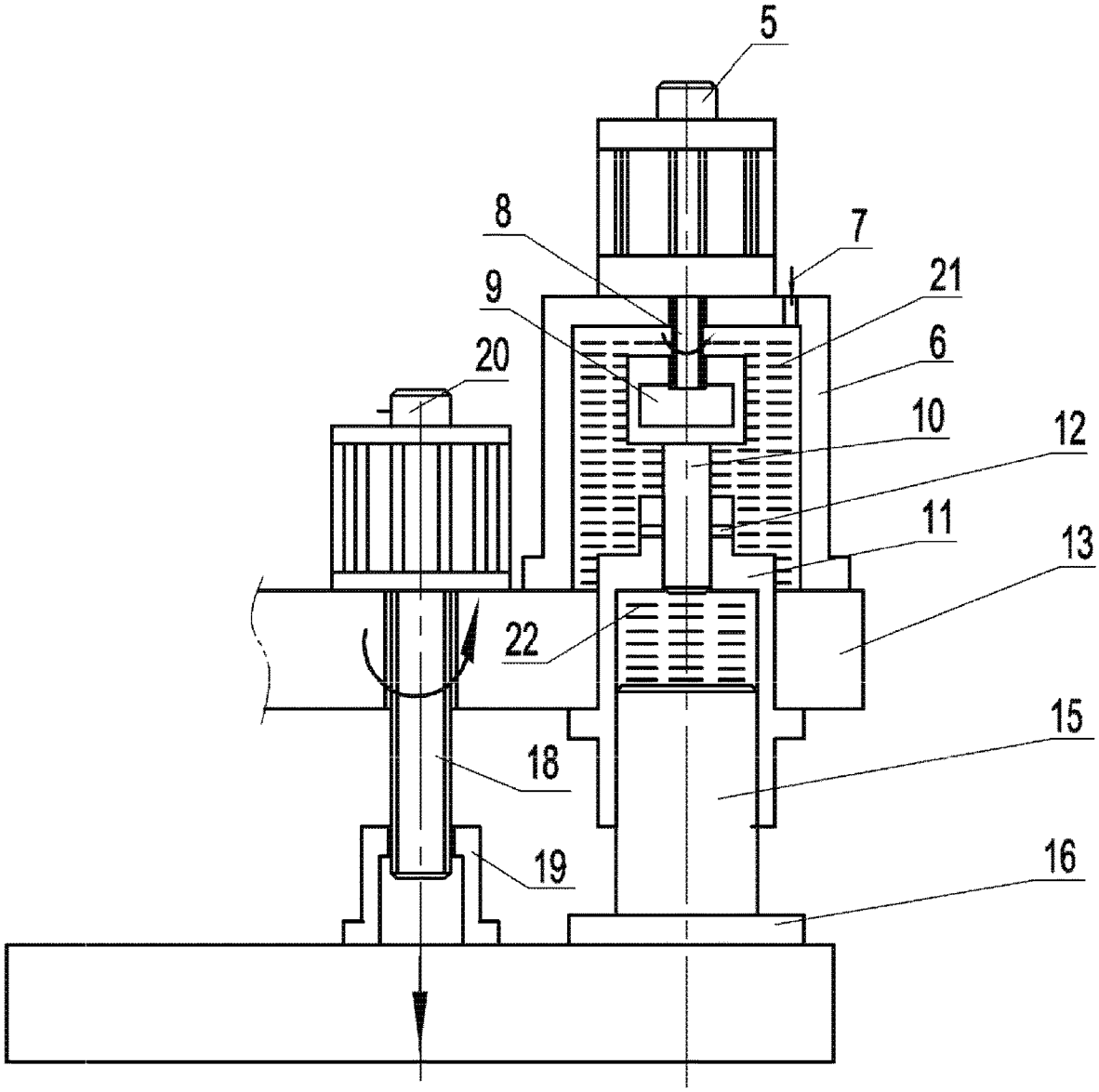
FIG. 3 is a section view of an inner-circulating high speed hydraulic system in a pressured state according to the first embodiment of the present invention.

With reference to FIG. 3, the hydraulic oil 21 propelled by the low pressure compressed air flows into the top of the hydraulic plunger 15 through the radial holes 12. At this time, the lifting servo motor 20 rotates according to the command sent from the control system, causing the lifting ball screw 18 to engage with the lifting ball nut 19, which in turn propels the moving platen 16 fixed to the hydraulic plunger 15 to move toward the lower fixed platform 17 according to a preset downward curve for approaching and pressing the lower fixed platform 17 without shocks. Thus, the action of "oil supplying with low pressure" is completed. Subsequently, the pressure servo motor 5 is initiated to drive the pressure ball screw 8 to rotate so that the pressure nut 9 propels the pressure plunger 10 to move downward in the figure. During the movement of the pressure plunger 10, it will firstly turn off the radial hole 12 at the top of the hydraulic plunger 15 so as to form a sealed "high pressure cylinder" on the top of the hydraulic plunger 15. When the pressure plunger 10 continues to move downward, the hydraulic oil in the sealed high pressure cylinder is compressed to generate a high pressure (for example, 400 $kg/cm^2$) within the high pressure cylinder, which in turn enables the hydraulic plunger 15 to generate a huge thrust. Provided that the rotation angle of the pressure servo motor 5 is changed, the moving position of the pressure plunger 10 might be changed and accordingly the thrust and position of the hydraulic plunger might also be changed.

Figure 4:
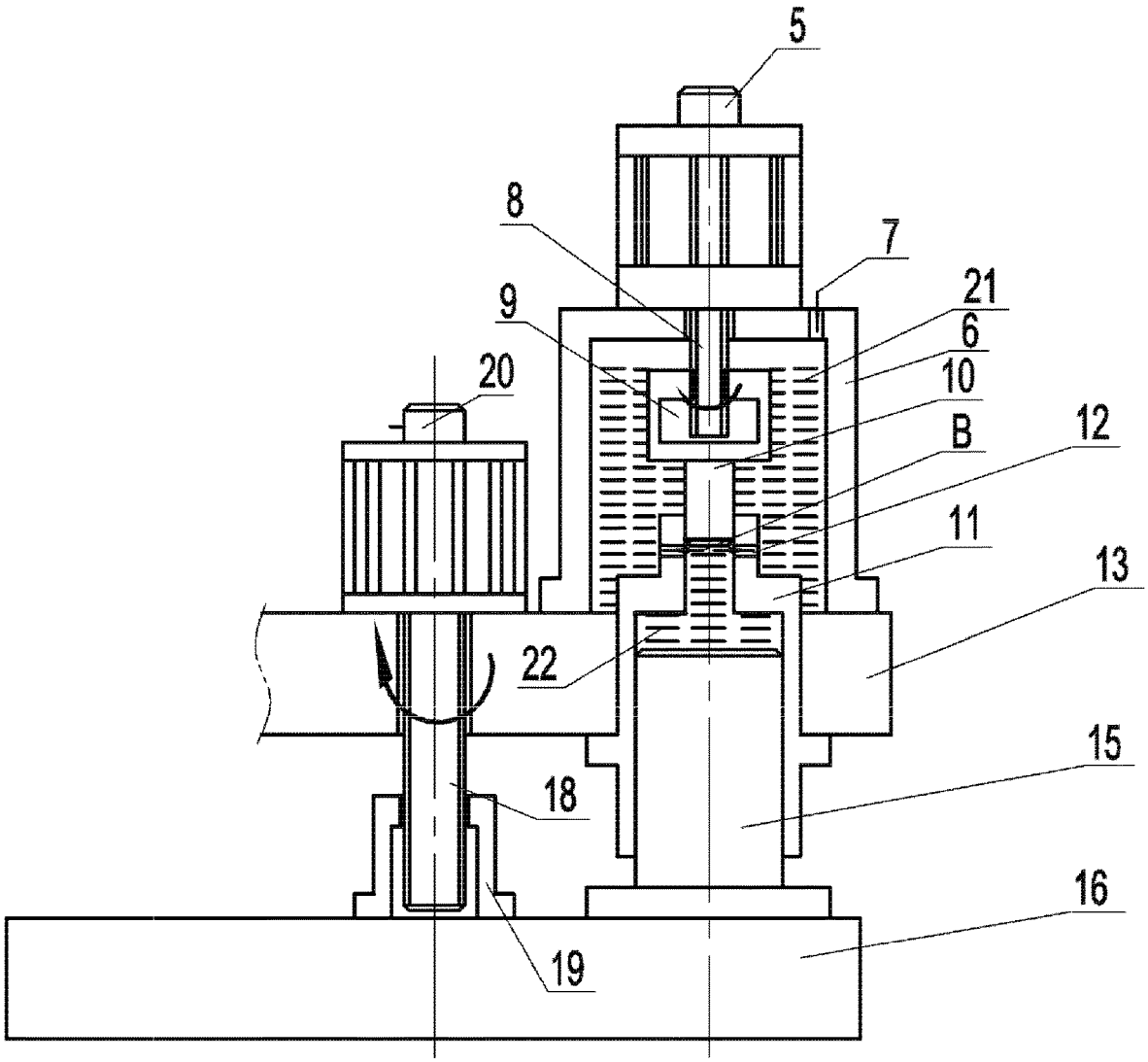
FIG. 4 is a section view of an inner-circulating high speed hydraulic system in a pressure-released state according to the first embodiment of the present invention.

With reference to FIG. 4, when the moving platen 16 is required to move upward back to the stationary state as shown in FIG. 2, the pressure servo motor 5 drives the pressure ball screw to rotate reversely. Then the pressure nut 9 will bring the pressure plunge 10 to move upward. When the pressure plunger 10 arrives at a position at which the radial hole 12 begins to be exposed, high pressure oil in said "high pressure cylinder" will discharge oil to the inter-circulating chamber along the direction B.

At this time, the lifting servo motor 20 rotates reversely, bringing the moving platen 16 together with the plunger 15 to move upward so that the hydraulic oil 21 may be completely discharged via the radial holes 12. Thus, all actions within a stroke are completed. Then, the platform returns back to the state shown in FIG. 2, waiting for next active command.

Figure 5:
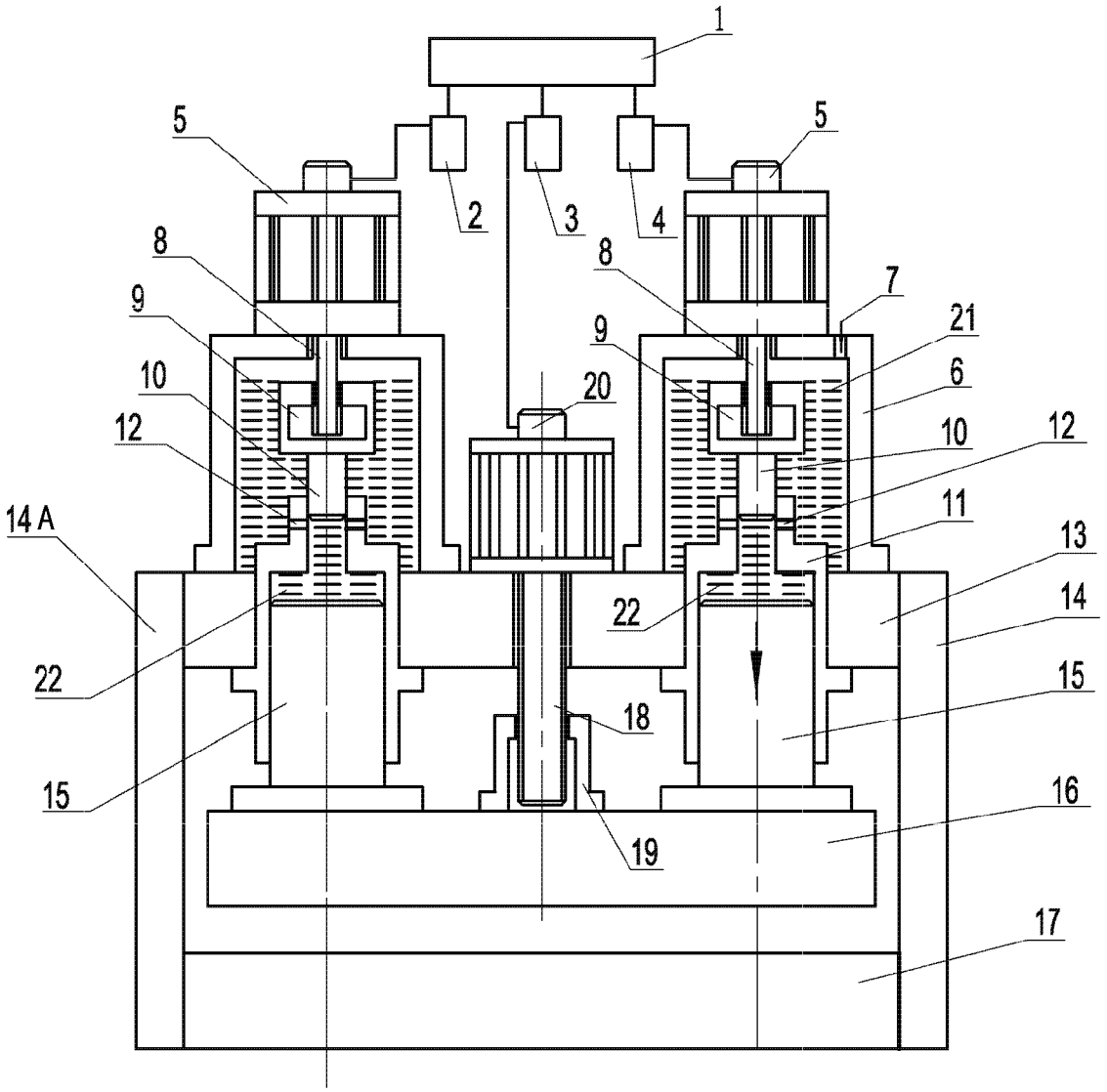
FIGS. 5-7 are section views of an inner-circulating high speed hydraulic platform comprising four inner-circulating high speed hydraulic systems in various states according to the present invention.
Figure 6:
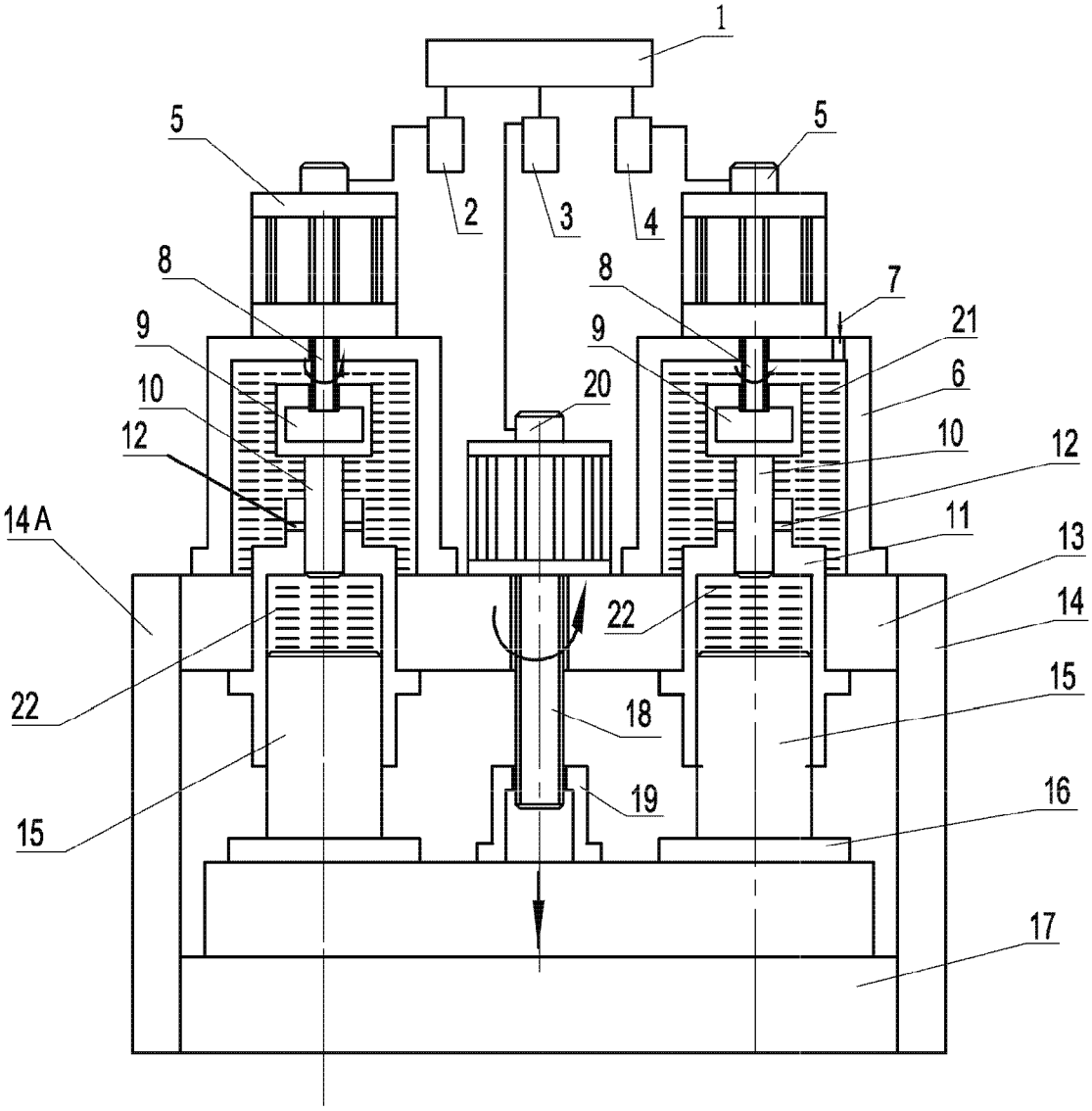
Figure 7:
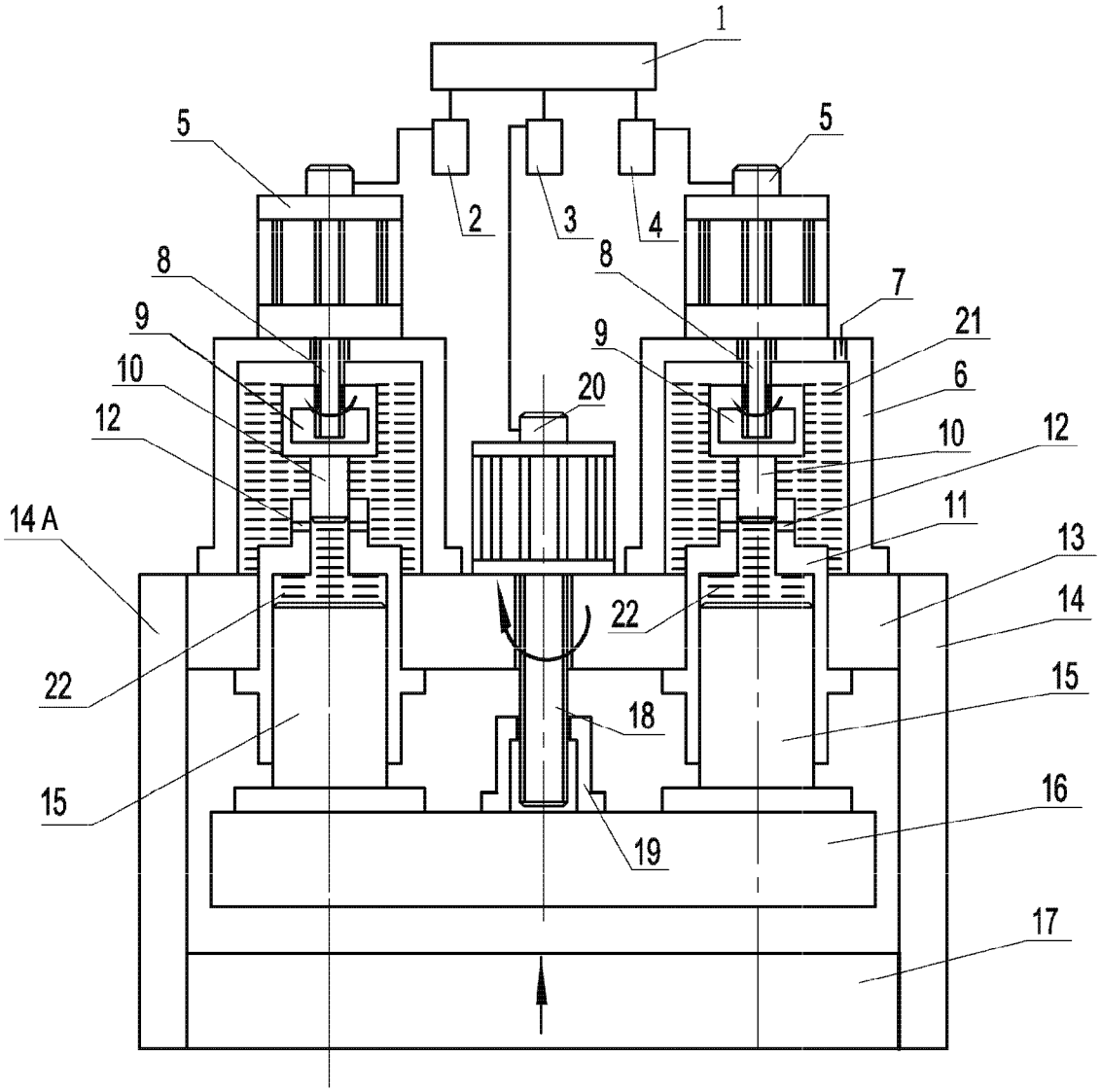

FIGS. 5-7 are section views of an inner-circulating high speed hydraulic platform comprising 4 inner-circulating high speed hydraulic systems (only two systems are shown in the figures while others are covered) in various states according to the present invention.

In addition to the inner-circulating high speed hydraulic platform, a lower fixed platform 17, a right wallboard 14 and a left wallboard 14A are also illustrated in FIGS. 5-7, wherein a platform supporting system consisting of an upper fixed platform 13, the lower fixed platform 17, the right wallboard 14 and the left wallboard 14A is used for fixing the inner-circulating high speed hydraulic platform to a device it applied, such as a stamping machine. The right wallboard 14 and the left wallboard 14A are vertically connected between the upper fixed platform 13 and the lower fixed platform 17 so that the relative positions of the upper and lower fixed platform 13, 17 are fixed and a space for containing the housing of the high pressure oil chamber 22 and the moving platen 16 reciprocating therein is formed. Furthermore, housings 6 of the hydraulic cylinder components are connected to the upper fixed platform 13 through fixtures such as bolt, rivet or the like. The cylinder of the high pressure oil chamber 22 is contained in a via formed in the upper fixed platform 13 and also fixed to the upper fixed platform 13. Undoubtedly, it should be understood that the housings 6 of the hydraulic cylinder components or the cylinder of the high pressure oil chamber 22 may also be formed with the upper fixed platform 13 integrally. The inner-circulating high speed hydraulic platform and the supporting system connected as above form an integral inner-circulating high speed hydraulic platform assembly. In this way, the so-constructed inner-circulating high speed hydraulic platform assembly has a compact structure and decreases the overall height of the assembly, and is easy for transportation.

Further, FIGS. 5-7 show a control system of the inner-circulating high speed hydraulic platform. With reference to FIG. 5, the control system comprises a controller 1, a driver 3 for the servo motor 20 corresponding to the moving platen lifting component, and drivers (only two drivers 2 and 4 are shown in the figure) for the servo motors 5 corresponding to the hydraulic cylinder components. According to the action requirements, the control system is used for sending corresponding commands to the servo motor 5 of the pressure valve components of the hydraulic cylinder components, the servo motor 20 of the moving platen lifting component, and other actuators, as well as receiving related feedback information therefrom, to ensure reliable operation of the inner-circulating high speed hydraulic platform with high speed, high pressure and high precision.

Next, the operational process of the inner-circulating high speed hydraulic platform under the control of the control system will be descried with reference to FIGS. 5-7.

FIG. 5 shows states of the respective components when the platform begins to move downward. When the moving platen 16 begins to press downward, a driving command for driving servo motor 20 to rotate is sent from the controller 1 to the driver 3 according to the preset action program. The rotation brings the lifting ball screw 18 to rotate and thus brings the engaged lifting nut 19 to follow an acceleration and deceleration curve preset by controller 1, causing the moving platen 16 to approach the lower fixed platform 17 with zero speed and press the lower fixed platform 17, i.e., arriving a state as shown in FIG. 6. With the downward movement of the moving platen 16, the compressed air is enabled to compress hydraulic oil 21 through compressed air inlets 7 of the inner-circulating high speed hydraulic system, causing the hydraulic oil 21 to rapidly enter the high pressure oil chamber 11 via the holes 12, thereby completing a downward stroke of the platform for oil supplying.

With reference to FIG. 6, when the lifting servo motor 20 arrives zero speed, the driver 3 may send an in-position signal to the controller 1 which simultaneously sends commands to drivers 2 and 4 for synchronously rotating the pressure servo motors 5. At this time, the pressure servo motors 5 operate synchronously and drive each pressure ball screw 3, thereby bring each pressure nut 9 to move linearly and propel the pressure plungers 10, which may firstly seal the holes 12 and compress the hydraulic oil in each high pressure cylinder 11 at the same time, thereby generate high pressure. It should be understood that the approach for synchronizing pressure servo motors 5 may use any method well known in the art, such as parallel control, master-slave control, cross-coupling control, virtual line-shaft control, relative coupling control, and so on.

With reference to FIG. 7, after all actions shown in FIG. 6 are completed, the controller 1 firstly may send rotation command to drivers 2 and 4. At this time, the pressure servo motors 5 also rotate according to the lifting curve preset by controller 1, bringing each pressure ball screw 8, respectively, to drive each pressure nut 9 and thus propel the pressure plungers 10 to make upward linear movement. When the plungers move and then stop at the position as shown in FIG. 7, the controller 1 may promptly send commands to the driver 3 for rotating the lifting servo motor 20. At this time, the lifting servo motors 20 drive the lifting servo ball screws 18, which in turn enable the lifting nuts 19 to bring the moving platen 16 and the hydraulic plunger 15 to move upward. At this time, the hydraulic oil 21 in the high pressure cylinder 11 is discharged back into the inner-circulating oil chamber through the holes 12. At this moment, all actions in the upward and downward strokes have been completed.

Although the present invention is described with reference to a first embodiment of an inner-circulating high speed hydraulic platform comprising four inner-circulating high speed hydraulic systems, the number of the inner-circulating high speed hydraulic systems in the present invention is not limited to four, but may be any number more than one.

It should be understood that the controller described herein may be implemented as a well known controller in the art, such as PLC, motion controller, and so on.

Descriptions regarding "upward/upper" and "downward/lower" used herein are not intended to limit the direction of components in figures during usage. It will be understood by those skilled in the art that the above system may be used inversely by modification, as will be describe with respect to the second embodiment below.

Figure 8:
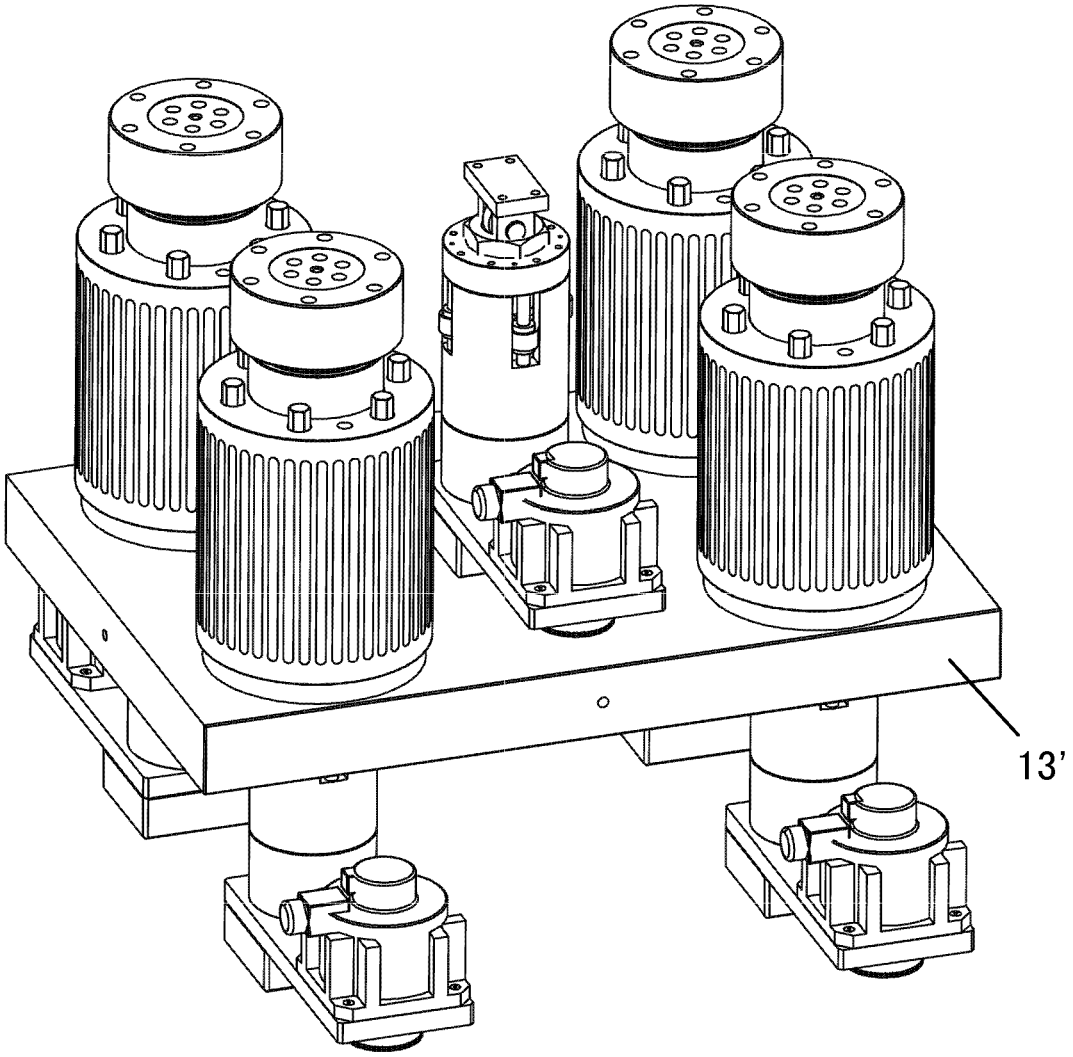
FIG. 8 illustrates a perspective view of an inner-circulating high speed hydraulic platform according to a second embodiment of the present invention, wherein a support for fixing the inner-circulating high speed hydraulic platform to a stamping machine, a control system, a moving platen and an upper fixed platform are omitted for clarity.

FIG. 8 shows a perspective view of an inner-circulating high speed hydraulic platform according to a second embodiment of the present invention. The inner-circulating high speed hydraulic platform mainly comprises: a lower fixed platform 13', a moving platen lifting component, a plurality of inner-circulating high speed hydraulic systems (for example, 2, 3, 5 etc. and specifically 4 in the present embodiment) mounted to the lower fixed platform 13', and a control system (not shown). The moving platen lifting component is used for pushing a moving platen 16 to move toward an upper fixed platform 17' and contact it with zero speed (See, FIG. 9). The inner-circulating high speed hydraulic systems are used for supplying fluid to the hydraulic system when pushing the moving platen 16 toward the upper fixed platform 17' and applying pressure on the upper fixed platform 17' after contacting the moving platen 16. The control system is used for sending corresponding commands to components according to action requirements and receiving related feedback information so as to ensure reliable operation of the inner-circulating high speed hydraulic platform with high speed, high pressure and high precision.

Figure 9:
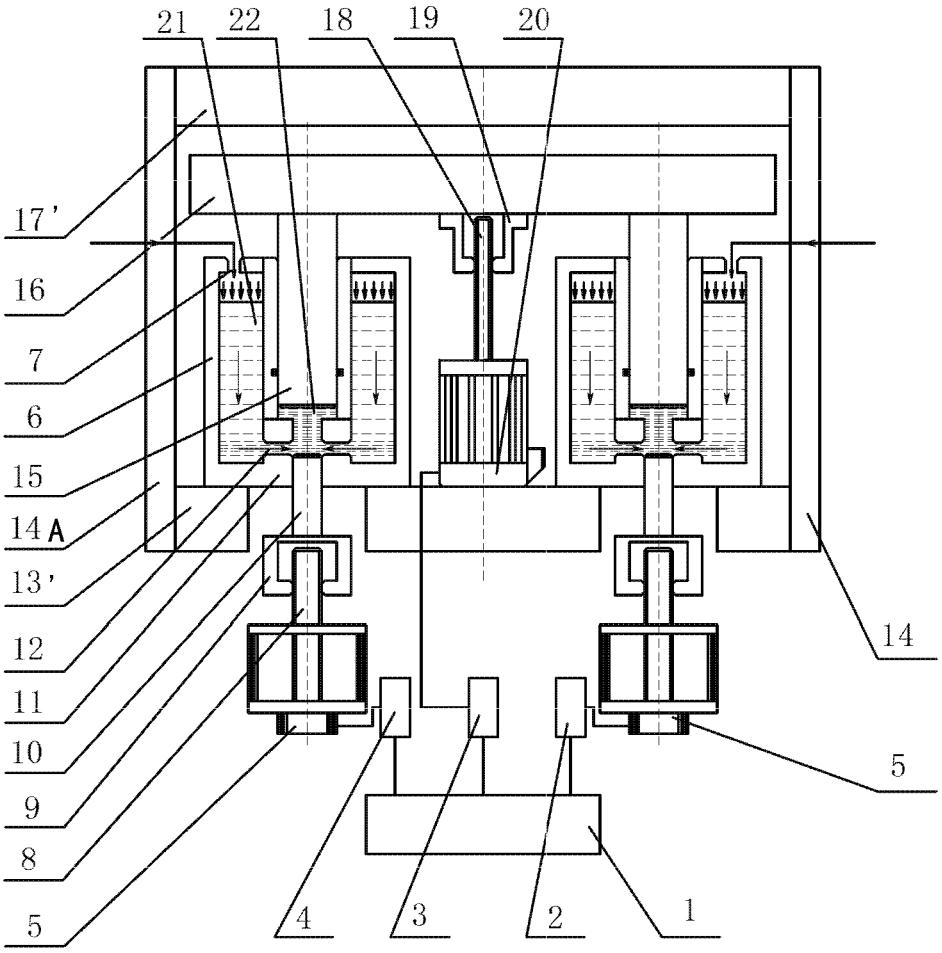
FIGS. 9-11 are section views of an inner-circulating high speed hydraulic platform in various states according to the second embodiment of the present invention.
Figure 10:
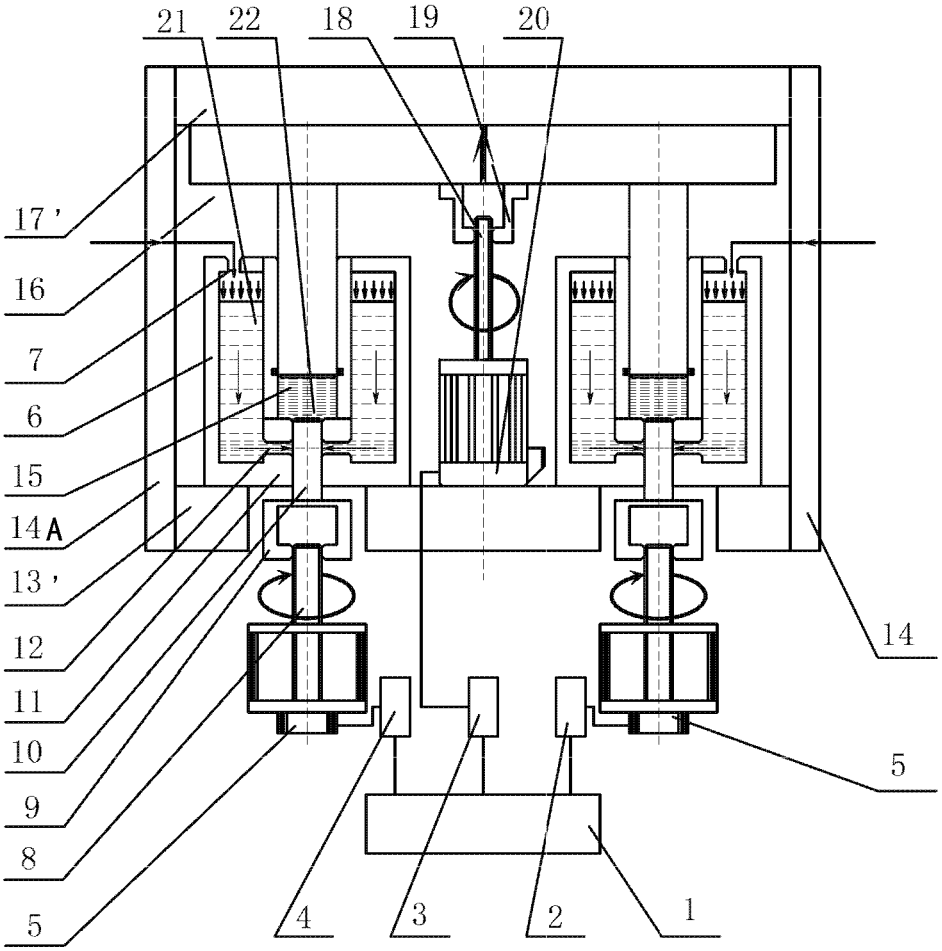
Figure 11:
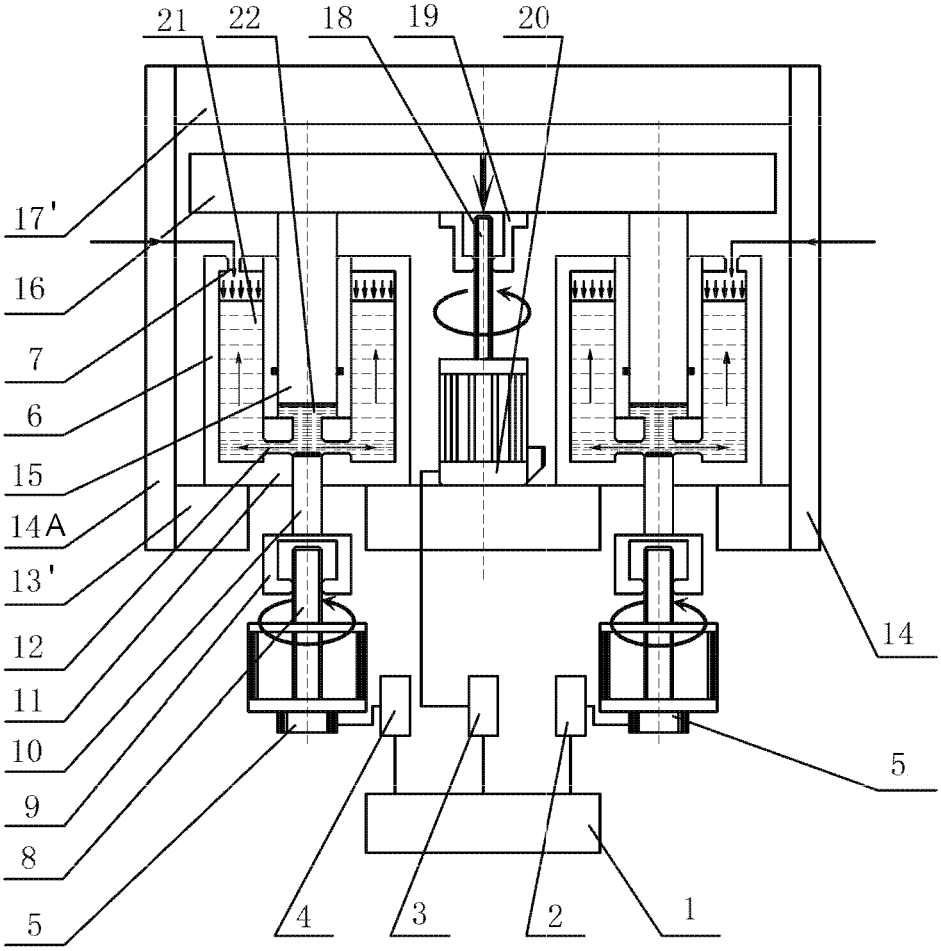

FIGS. 9-11 are section views of an inner-circulating high speed hydraulic platform comprising 4 inner-circulating high speed hydraulic systems (only two systems are shown in the figures while others are covered) in various states according to the present invention.

In this embodiment, the inner-circulating high speed hydraulic platform comprises four identical inner-circulating high speed hydraulic systems. However, it should be understood that the present invention is not limited to four identical inner-circulating high speed hydraulic systems but may take any appropriate number of systems, such as 2, 3, etc. The four inner-circulating high speed hydraulic systems may have similar structure and operational process to those of the first embodiment. Herein, only one of the systems is described in details with reference to FIG. 9.

Taking the hydraulic cylinder component shown in the left side of the FIG. 9 as an example, it comprises a high pressure cylinder 11, a hydraulic plunger 15, and a housing 6. An axial hole, disposed at the bottom of the high pressure cylinder 11, may communicate with a chamber on the bottom of the hydraulic plunger 15. At least one radial hole(s) 12 intersecting with the axial hole is also disposed near the bottom of the high pressure cylinder 11. The plunger 15 reciprocates in the high pressure cylinder 11, the upper end of which may connect to an actuating element, which in the preferred embodiment is a moving platen 16. The housing 6 contains the high pressure cylinder 11 and form a sealed inner-circulating chamber outside. The inner-circulating chamber may communicate with the axial hole via the aforementioned at least one radial hole 12 and in turn communicate with the bottom of the hydraulic plunger 15. In addition, a compressed air inlet 7 is disposed at the top of the housing 6 for introducing compressed air.

A pressure valve component comprising a pressure servo motor 5 and a pressure plunger 10 is disposed at the bottom of the hydraulic cylinder component. The pressure plunger 10 may be driven by the pressure servo motor 5 to move up and down within an axial hole disposed at the bottom of the high pressure cylinder 11. In this embodiment, a driving mechanism may be disposed between the pressure servo motor 5 and the pressure plunger 10. The driving mechanism comprises a pressure ball screw 8 and a pressure nut 9 which is engaged with the pressure ball screw 8 for moving. The pressure ball screw 8 is connected to the pressure servo motor 5 and supported by a bearing to rotate. The pressure nut 9 is connected to a pressure plunger 10.

It should be understood that the pressure plunger 10 may be directly driven by servo motor 5, if desired.

The functions of the pressure valve component are as follows. The pressure servo motor 5 enables the pressure plunger 10 to appropriately turn off hydraulic oil in at least one radial hole 12 of the hydraulic cylinder component according to command(s) received from the control system, which in turn enables the pressure plunger 10 to move into the high pressure chamber 22 at the bottom of the hydraulic plunger 15. When the pressure plunger 10 continues to move upward, the low pressure hydraulic oil 21 at the bottom of the hydraulic plunger 15 will be compressed, which will increase the pressure in the sealed chamber (up to 400 $kg/cm^2$) and cause a significant thrust on the hydraulic plunger 15. Provided that the moving distance of the pressure plunger 10 toward the top of the hydraulic plunger 15 is controlled, the generated thrust of the hydraulic plunger 15 and its highly precise position (for example, with a positional repeatability of ±0.01 mm) may be controlled.

FIG. 9 also show a moving platen lifting component. The moving platen lifting component is connected to said moving platen 16, comprising: a lifting servo motor 20 and a lifting mechanism. The lifting mechanism may be driven by the lifting servo motor 20, causing the moving platen 16 to perform lifting movement according to a preset lifting curve. In this embodiment, the lifting mechanism comprises a lifting ball screw 18 and a lifting nut 19 engaged with the lifting ball screw 18 for moving. The lifting ball screw 18 is connected to the lifting servo motor 20 while the lifting nut 9 is connected to the moving platen 16.

The moving platen lifting component enables the moving platen 16 to approach the fixed platen with high speed and zero-speed contact with the fixed platen with high precision and press it tightly. Meanwhile, the hydraulic plunger 15 fixed on the moving platen 16 is pulled to have the high pressure hydraulic cylinder 11 thereon oil supplied or discharged.

Hereinafter, the action process of the hydraulic system according to a preferred embodiment of the present invention will be described with respect to FIGS. 9-11.

In FIG. 9, the hydraulic system is in a static state. In this state, low pressure compressed air enters an inner-circulating oil chamber via a compressed air inlet 7, causing the hydraulic oil 21 to flow into the bottom of the hydraulic plunger 15 through the radial holes 12 along direction A so that the hydraulic plunger 15 is enabled to generate an upward low pressure thrust. At this time, the moving platen lifting component is constrained by a static torque generated from the servo motor 20, which in turn constrains the moving platen 16 and the hydraulic plunger 15 to maintain in a static state as shown in FIG. 9. This state is referred as "state of origin" for the hydraulic system in the present invention.

With reference to FIG. 10, the hydraulic oil 21 propelled by the low pressure compressed air flows into the bottom of the hydraulic plunger 15 through the radial hole 12. At this time, the lifting servo motor 20 rotates according to the commands sent from the control system, causing the lifting ball screw 18 to engage with the lifting ball nut 19, which in turn propels the moving platen 16 fixed to the hydraulic plunger 15 to move toward the upper fixed platform 17' according to a preset downward curve for approaching and tightly pressing the upper fixed platform 17' without shock. Thus, the action of "oil supplying with low pressure" is completed. Subsequently, the pressure servo motor 5 is initiated to drive the pressure ball screw 8 to rotate so that the pressure nut 9 propels the pressure plunger 10 to move upward in the figure. During the movement of the pressure plunger 10, it will firstly turn off the radial hole 12 at the bottom of the hydraulic plunger 15 so as to form a sealed "high pressure cylinder" below the bottom of the hydraulic plunger 15. When the pressure plunger 10 continues to move upward, the hydraulic oil in the sealed high pressure cylinder is compressed to generate a high pressure (for example, 400 $kg/cm^2$), which in turn enables the hydraulic plunger 15 to generate a huge thrust. Provided that the rotation angle of the pressure servo motor 5 is changed, the moving position of the pressure plunger 10 might be changed, and accordingly the thrust and position of the hydraulic plunger might also be changed.

With reference to FIG. 11, when the moving platen 16 is required to move downward to return to the stationary state as shown in FIG. 9, the pressure servo motor 5 drives the pressure ball screw to rotate reversely. Then the pressure nut 9 will bring the pressure plunge 10 to move downward. When the pressure plunger 10 moves to a position at which the radial hole 12 begins to be exposed, high pressure oils in said "high pressure cylinder" will discharge oil to the inter-circulating chamber.

At this time, the lifting servo motor 20 rotates reversely, bringing the moving platen 16 together with the plunger 15 to move downward so that the hydraulic oil 21 may be completely discharged via the radial hole 12. Thus, all actions within a stroke are completed. Then, the platform returns back to the state shown in FIG. 9 waiting for next action command.

In addition to the inner-circulating high speed hydraulic platform, an upper fixed platform 17', a right wallboard 14 and a left wallboard 14A are also illustrated in FIGS. 9-11, wherein a platform supporting system consisting of an lower fixed platform 13', the upper fixed platform 17', the right wallboard 14 and the left wallboard 14A is used for fixing the inner-circulating high speed hydraulic platform to a device, such as a stamping machine, to which it applied. The right wallboard 14 and the left wallboard 14A are vertically connected between the lower fixed platform 13' and the upper fixed platform 17' so that the relative positions of the lower and upper fixed platform 13', 17' are fixed and a space for containing the housing of the high pressure oil chamber 22 and the moving platen 16 reciprocating therein is formed. Furthermore, housings 6 of the hydraulic cylinder component are connected to the lower fixed platform 13' through fixtures such as bolt, rivet or the like. The pressure valve component passes through a via formed in the lower fixed platform 13' and is also fixed to the lower fixed platform 13'. Undoubtedly, it should be understood that the housings 6 of the hydraulic cylinder component or the cylinder of the high pressure oil chamber 22 may also be formed with the lower fixed platform 13' integrally. The inner-circulating high speed hydraulic platform and the supporting system connected as above form an integral inner-circulating high speed hydraulic platform assembly. In this way, the so-constructed inner-circulating high speed hydraulic platform assembly has a compact structure, decreases the overall height of the assembly, and thereby is easy for transportation.

Further, FIGS. 9-11 also show a control system of the inner-circulating high speed hydraulic platform. With reference to FIG. 9, the control system of the present invention comprises a controller 1, a driver 3 for the servo motor 20 corresponding to the moving platen lifting component, and drivers (only two drivers 2 and 4 are shown in the figure) for the servo motor 5 corresponding to the hydraulic cylinder components. According to the action requirements, the control system is used for sending corresponding commands to the servo motor 5 of the pressure valve components of the hydraulic cylinder components, the servo motor 20 of the moving platen lifting component, and other actuators, as well as receiving related feedback information therefrom, to ensure reliable operation of the inner-circulating high speed hydraulic platform with high speed, high pressure and high precision.

Next, the operational process of the inner-circulating high speed hydraulic platform under the control of the control system will be descried with reference to FIGS. 9-11.

FIG. 9 shows states of components when the platform begins to move upward. When the moving platen 16 begins to press upward, a driving command for driving servo motor 20 to rotate is sent from the controller 1 to the driver 3 according to the preset action program. The rotation brings the lifting ball screw 18 to rotate and thus brings the engaged lifting ball nut 19 to follow an acceleration and deceleration curve preset by controller 1, causing the moving platen 16 to approach the upper fixed platform 17' with zero speed and tightly press the upper fixed platform 17', i.e., arriving a state as shown in FIG. 10. With the upward movement of the moving platen 16, the compressed air is enabled to compress hydraulic oil 21 through compressed air inlets 7 of the inner-circulating high speed hydraulic system, causing hydraulic oil 21 to rapidly enter a high pressure oil chamber 11 through the holes 12, thereby completing an upward stroke of the platform for oil supplying.

With reference to FIG. 10, when the lifting servo motor 20 arrives zero speed, the driver 3 sends an in-position signal to the controller 1 which simultaneously sends commands to drivers 2 and 4 for synchronously rotating the pressure servo motors 5. At this time, the pressure servo motors 5 operate synchronously and drive each pressure ball screw 3, respectively to bring each pressure nut 9 to move linearly and propel the pressure plungers 10, which may firstly seal the holes 12 and compress the hydraulic oil in each high pressure cylinder 11 at the same time, thereby generating high pressure. It should be understood that the approach for synchronizing pressure servo motors 5 may use any method well known in the art, such as parallel control, master-slave control, cross-coupling control, virtual line-shaft control, relative coupling control, and so on.

With reference to FIG. 11, after all actions shown in FIG. 10 are completed, the controller 1 firstly sends rotation commands to drivers 2 and 4. At this time, the pressure servo motors 5 also rotate according to the lifting curve preset by controller 1, bringing each pressure ball screw 8, respectively, to drive each pressure nut 9 and propel the pressure plungers 10 to make downward linear movement. When the pressure plungers 10 move and stop the position as shown in FIG. 11, the controller may send commands to the driver 3 for rotating the lifting servo motor 20. At this time, the lifting servo motors 20 drive the lifting servo ball screws 18 to enable the lifting nuts 19 to bring the moving platen 16 and the hydraulic plunger 15 to move downward. At this time, the hydraulic oil 21 in the high pressure cylinder 11 is discharged back into the inner-circulating oil chamber through the holes 12. At this moment, all actions in the downward strokes have been completed.

Although the present invention is described with reference to a second embodiment of an inner-circulating high speed hydraulic platform comprising four inner-circulating high speed hydraulic systems, the number of the inner-circulating high speed hydraulic systems in the present invention is not limited to four, but may be any number more than one.

It should be understood that the controller described herein may be implemented as a well known controller in the art, such as PLC, motion controller, and so on.

Descriptions regarding "upward/upper" and "downward/lower" used herein are not intended to limit the direction of components in figures during usage.

While the present invention is specifically described with respect to the preferred embodiments, it should be understood by those skilled that various changes and modifications could be made on the basis of the aforementioned disclosure without departing from the essential thereof. Thus, the scope of the invention is defined by the appended claims.

What is claimed is:

1. An inner-circulating hydraulic system, comprising:

a hydraulic cylinder component, including a cylinder, a hydraulic plunger, and a housing, wherein an axial hole disposed near the top of the cylinder communicates with a chamber on the top of the hydraulic plunger, wherein at least one radial hole intersecting the axial hole is also disposed near the top of the cylinder, wherein the hydraulic plunger reciprocates in the cylinder, wherein the housing contains the cylinder and forms a sealed inner-circulating oil chamber outside of the chamber and contained within the housing, wherein the inner-circulating oil chamber fluidly communicates with the axial hole via said radial hole and in turn fluidly communicates with the chamber on the top of the hydraulic plunger, wherein a compressed air inlet is disposed in the upper portion of the housing and a lower end of the hydraulic plunger is connected to a moving platen; and a pressure valve component, comprising a pressure servo motor and a pressure plunger driven by the pressure servo motor to move up and down within the axial hole disposed at the top of the cylinder.

2. The inner-circulating hydraulic system of claim 1, wherein the moving platen is a moving platen of a moving platform.

3. The inner-circulating hydraulic system of claim 2, wherein the hydraulic system further comprises a moving platen lifting component connected to the moving platen, the moving platen lifting component including a lifting servo motor and a lifting mechanism, wherein the lifting mechanism is driven by the lifting servo motor so that the moving platen makes a lifting movement according to a preset lifting curve.

4. The inner-circulating hydraulic system of claim 3, wherein the lifting mechanism comprises a lifting ball screw and a lifting nut engaged with the lifting ball screw for moving, wherein the lifting ball screw is connected to the lifting servo motor while the lifting nut is connected to the moving platen.

5. The inner-circulating hydraulic system of claim 1, wherein a driving mechanism is disposed between the pressure servo motor and the pressure plunger.

6. The inner-circulating hydraulic system of claim 5, wherein the driving mechanism comprises a pressure ball screw and a pressure nut engaged with the pressure ball screw for moving, wherein the pressure ball screw is connected to the pressure servo motor while the pressure nut is connected to the pressure platen.

7. The inner-circulating hydraulic system of claim 1, wherein the pressure plunger is directly driven by a linear servo motor.

8. An inner-circulating hydraulic platform, comprising:

an inner-circulating hydraulic moving platform system, comprising:

a hydraulic cylinder component, including a cylinder, a hydraulic plunger, and a housing, wherein an axial hole disposed at the bottom of the cylinder communicates with a chamber on the bottom of the hydraulic plunger, wherein at least one radial hole intersecting with the axial hole is also disposed near the bottom of the cylinder, wherein the hydraulic plunger reciprocates in the cylinder, wherein the housing contains the cylinder and forms a sealed inner-circulating oil chamber outside of the chamber and contained within the housing, wherein the inner-circulating oil chamber fluidly communicates with the axial hole via said radial hole and in turn fluidly communicates with the chamber on the bottom of the hydraulic plunger, wherein a compressed air inlet is disposed on the upper portion of the housing and an upper end of the hydraulic plunger is connected to a moving platen; and an upper fixed platform, connected to the inner-circulating hydraulic moving platform system; a moving platen lifting component connected to the moving platen and comprising a lifting servo motor and a lifting mechanism, wherein the lifting mechanism is driven by the lifting servo motor to enable the moving platen to perform lifting movement; and a control system for controlling the above components to act in proper time and controlling the lifting servo motor in the inner-circulating hydraulic moving platform system to operate synchronously.

9. The inner-circulating hydraulic platform of claim 8, wherein the lifting mechanism comprises a lifting ball screw and a lifting nut engaged with the lifting ball screw for moving, wherein the lifting ball screw is connected to the lifting servo motor while the lifting nut is connected to the moving platen.

10. The inner-circulating hydraulic platform of claim 8, further comprising:

a pressure valve component, comprising a pressure servo motor and a pressure plunger driven by the pressure servo motor to move up and down within the axial hole disposed at the bottom of the cylinder; and wherein the control system comprises a controller, a first driver corresponding to the pressure servo motor, and a second driver corresponding to the lifting servo motor, wherein the controller is configured to:

send actuating commands to the second driver corresponding to the lifting servo motor so that the hydraulic plunger is driven to move downward, which in turn brings the moving platen to move downward;

when the moving platen stops moving downward, the controller receives an in-position signal from the second driver of the lifting servo motor and sends commands to the first driver of the pressure servo motor for synchronously running so as to synchronously drive the pressure plunger to enter into the chamber and seal the radial hole;

send commands to the first driver of the pressure servo motor for synchronously reverse running so as to synchronously drive the pressure plunger to exit the chamber upward; and send commands to the second driver of the lifting servo motor for driving the hydraulic plunger to move reversely, and bringing the moving platen to move upward.

11. The inner-circulating hydraulic platform of claim 10, wherein the controller is a PLC or a motion controller.

12. The inner-circulating hydraulic platform of claim 8, further comprising:

a connecting mechanism connecting and fixing the upper fixed platform and a lower fixed platform;

wherein when the moving platen reciprocates to a lower stop point, the moving platen contacts the lower fixed platform with zero speed and tightly presses it; and the housing of the hydraulic cylinder is fixed to the upper fixed platform, wherein the cylinder is contained in an aperture formed in the upper fixed platform and also fixed to the upper fixed platform.

13. The inner-circulating hydraulic platform of claim 12, wherein the connecting mechanism comprises a right wallboard and a left wallboard which are connected between the upper fixed platform and lower fixed platform.

14. An inner-circulating hydraulic platform, comprising:

a lower fixed platform, the lower fixed platform connected to:

at least one inner-circulating moving platform hydraulic system, comprising:

a hydraulic cylinder component, including a cylinder, a hydraulic plunger, and a housing, wherein an axial hole disposed at the bottom of the cylinder communicates with a chamber on the bottom of the hydraulic plunger, wherein at least one radial hole intersecting with the axial hole is also disposed near the bottom of the cylinder, wherein the hydraulic plunger reciprocates in the cylinder, wherein the housing contains the cylinder and forms a sealed inner-circulating oil chamber outside of the chamber and contained within the housing, wherein the inner-circulating oil chamber fluidly communicates with the axial hole via said radial hole and in turn fluidly communicates with the chamber on the bottom of the hydraulic plunger, wherein a compressed air inlet is disposed on the upper portion of the housing and an upper end of the hydraulic plunger is connected to a moving platen; and a pressure valve component, comprising a pressure servo motor and a pressure plunger driven by the pressure servo motor to move up and down within the axial hole disposed at the bottom of the cylinder;

a moving platen lifting component connected to the moving platen and comprising a lifting servo motor and a lifting mechanism, wherein the lifting mechanism is driven by the lifting servo motor to enable the moving platen to perform lifting movement; and a control system for controlling the above components to act in proper time and controlling the pressure and lifting servo motors in the inner-circulating hydraulic moving platform system to operate synchronously.

15. The inner-circulating hydraulic platform of claim 14, wherein the lifting mechanism comprises a lifting ball screw and a lifting nut engaged with the lifting ball screw for moving, wherein the lifting ball screw is connected to the lifting servo motor while the lifting nut is connected to the moving platen.

16. The inner-circulating hydraulic platform of claim 14, wherein the control system comprises a controller, a first driver corresponding to the pressure servo motor of the at least one inner-circulating hydraulic moving platform system, and a second driver corresponding to the lifting servo motor, wherein the controller is configured to:

send actuating commands to the second driver corresponding to the lifting servo motor so that the hydraulic plunger is driven to move upward, which in turn drives the moving platen to move upward;

when the moving platen stops moving upward, the controller receives an in-position signal from the second driver of the lifting servo motor and sends commands to the first driver of the pressure servo motor for synchronously running to synchronously drive the pressure plunger to enter into the chamber and seal the radial hole;

send commands to the first driver of the pressure servo motor for synchronously reverse running to synchronously drive the pressure plunger exiting the chamber downward; and send commands to the second driver of the lifting servo motor for driving the hydraulic plunger to move reversely, which in turn brings the moving platen to move downward.

17. The inner-circulating hydraulic platform of claim 14, wherein the controller is a PLC or a motion controller.

18. The inner-circulating hydraulic platform of claim 14, further comprising:

a connecting mechanism connecting and fixing the lower fixed platform and an upper fixed platform;

wherein when the moving platen reciprocates to a lower stop point, the moving platen contacts the upper fixed platform with zero speed and tightly presses it;

wherein the housing of the hydraulic cylinder is fixed to the lower fixed platform, and wherein the pressure valve component passes through an aperture formed in the lower fixed platform and is fixed to the lower fixed platform.

19. The inner-circulating hydraulic platform of claim 18, wherein the connecting mechanism comprises a right wallboard and a left wallboard, both wallboards connected between the lower fixed platform and the upper fixed platform.

* * * * *